US007831158B2

(12) United States Patent
Hisatomi

(10) Patent No.: US 7,831,158 B2
(45) Date of Patent: Nov. 9, 2010

(54) IMAGE FORMING APPARATUS CAPABLE OF CONTROLLING TONER SUPPLY

(75) Inventor: Shinichi Hisatomi, Suwon si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1031 days.

(21) Appl. No.: 11/510,566

(22) Filed: Aug. 28, 2006

(65) Prior Publication Data

US 2007/0053704 A1 Mar. 8, 2007

(30) Foreign Application Priority Data

Sep. 6, 2005 (KR) ..... 10-2005-0082807

(51) Int. Cl.
*G03G 15/08* (2006.01)

(52) U.S. Cl. ..... 399/27; 399/28; 399/30; 399/58; 399/61; 399/258

(58) Field of Classification Search ..... 399/27, 399/28, 30, 58, 61, 258
See application file for complete search history.

(56) References Cited

U.S. PATENT DOCUMENTS 5,162,849 A * 11/1992 Yoshino et al. ..... 399/29
2005/0063715 A1* 3/2005 Suzuki et al. ..... 399/27

FOREIGN PATENT DOCUMENTS

| | | |
|---|---|---|
| JP | 07-295310 | 11/1995 |
| JP | 2000-29295 | 1/2000 |
| KR | 1999-79819 | 11/1999 |
| KR | 2003-42057 | 5/2003 |

OTHER PUBLICATIONS

Korean Patent Abstract for Publication No. 10-319846.

* cited by examiner

*Primary Examiner*—Ryan D Walsh
(74) *Attorney, Agent, or Firm*—Staas & Halsey LLP

(57) ABSTRACT

An image forming apparatus, including a toner supplying unit to supply toner, a toner transporting unit to transport the toner supplied from the toner supplying unit, a sensor to sense a density of the toner transported by the toner transporting unit, a compensating signal generating unit to compensate for amounts of the toner pre-supplied by the toner supplying unit, and a control unit to generate a control signal to control the toner supplying unit by receiving a sensing signal of the sensor as an input signal and a compensating signal of the compensating signal generating unit as a feedback signal.

10 Claims, 7 Drawing Sheets

FIG. 4

| TIME | CONTROL UNIT | | | SHIFT REGISTER | | | SUMMING COUNTER($V_b$) |
|---|---|---|---|---|---|---|---|
| | $V_{in}$ | $\Delta V$ | $V_c$ | $S_1$ | $S_2$ | $S_3$ | |
| T | $V_1$ | $\Delta V_1$ | $\Delta V_1$ | $\Delta V_1$ | ○ | ○ | $\Delta V_1$ |
| 2T | $V_2$ | $\Delta V_2$ | $\Delta V_2-\Delta V_1$ | $\Delta V_2-\Delta V_1$ | $\Delta V_2$ | ○ | $\Delta V_2$ |
| 3T | $V_3$ | $\Delta V_3$ | $\Delta V_3-\Delta V_2$ | $\Delta V_3-\Delta V_2$ | $\Delta V_2-\Delta V_1$ | $\Delta V_3$ | $\Delta V_3$ |
| 4T | $V_4$ | $\Delta V_4$ | $\Delta V_4-\Delta V_3$ | $\Delta V_4-\Delta V_3$ | $\Delta V_3-\Delta V_2$ | $\Delta V_2-\Delta V_1$ | $\Delta V_4-\Delta V_1$ |
| 5T | $V_5$ | $\Delta V_5$ | $\Delta V_5-\Delta V_4+\Delta V_1$ | $\Delta V_5-\Delta V_4+\Delta V_1$ | $\Delta V_4-\Delta V_3$ | $\Delta V_3-\Delta V_2$ | $\Delta V_5+\Delta V_1-\Delta V_2$ |
| ⋮ | ⋮ | ⋮ | ⋮ | ⋮ | ⋮ | ⋮ | ⋮ |

IMAGE FORMING APPARATUS CAPABLE OF CONTROLLING TONER SUPPLY

CROSS-REFERENCE TO RELATED APPLICATIONS

This application claims the benefit of Korean Application No. 2005-82807, filed Sep. 6, 2005, in the Korean Intellectual Property Office, the disclosure of which is incorporated herein by reference.

BACKGROUND OF THE INVENTION

1. Field of the Invention

An aspect of the present invention relates to an image forming apparatus capable of controlling toner supply, and, more particularly, to an image forming apparatus capable of controlling toner supply by compensating amounts of toner pre-supplied.

2. Description of the Related Art

Generally, an image forming apparatus includes a recording medium supplying unit to supply a recording medium, an image forming unit to form an image on the supplied recording medium, and a paper discharging unit to discharge the recording on which the image is formed. FIG. 1 is a schematic diagram that shows the image forming unit.

The image forming unit 100 comprises a photosensitive drum 110 and a transition roller 120 that rotate in correspondence with each other, a developer 130 to provide toner 1 to the photosensitive drum 110, and a toner supplying unit 140 to supply the toner 1 to the developer 130. Further, the developer 130 comprises a toner transporting unit 131 to transport the toner 1 provided from the toner supplying unit 140, a developing roller 132 to transport the toner 1 which is transported by the toner transporting unit 131 into the photosensitive drum 110, and a sensor 133 to sense a density of the toner 1 transported by the toner transporting unit 131.

Therefore, the toner supplied from the toner supplying unit 140 to the developer 130 is sensed by the sensor 133 and if the toner is sensed as having reached a proper density, controlling amounts of the toner supplied by the toner supplying unit 140 is possible by controlling driving of a supply motor 150 by a control unit (not shown) equipped in the image forming apparatus.

FIG. 2 shows a location relation between the toner transporting unit 131 and the sensor 133. In the drawing, the toner supply is provided in a right end of the toner transporting unit 131 and the supplied toner is transported to a left side of the toner transporting unit 130 by a rotation of the toner transporting unit 131. The sensor 133 is separated from a supply position P of the toner by a predetermined distance D and detects the density of the transported toner.

However, according to the above-described toner supplying and transporting method, a desired time for the supplied toner to reach the sensor 133 is required since the supply position P of the toner and a position of the sensor 133 are separated from each other, and consequently a delay time occurs in a controlling of the toner supplying unit 140 based on the sensing signal of the sensor 133. Therefore, since the toner supply in the toner supplying unit 140 is controlled in a condition of being delayed for a prescribed time, the toner may be excessively supplied during that time. If the toner is excessively supplied from the developer 130, the printing image on the recording medium deteriorates due to an excessive supply of the toner (i.e., an over-toner state).

SUMMARY OF THE INVENTION

Accordingly, it is an aspect of the present invention to provide an image forming apparatus capable of preventing excessive supply of toner by controlling toner supply.

The foregoing and/or other aspects of the present invention can be achieved by providing an image forming apparatus comprising a toner supplying unit to supply toner, a toner transporting unit to transport the toner supplied from the toner supplying unit, a sensor to sense a density of the toner transported by the toner transporting unit, a compensating signal generating unit to compensate amounts of the toner pre-supplied by the toner supplying unit, and a control unit to generate a control signal to control the toner supplying unit by receiving a sensing signal of the sensor as an input signal and a compensating signal of the compensating signal generating unit as a feedback signal.

According to an aspect of the present invention, the compensating signal generating unit comprises a plurality of shift registers to update consecutively the control signal of the control unit at a prescribed period and to store it; and a summing counter to sum the signal stored in the plurality of shift registers at the prescribed period to generate the compensating signal.

According to an aspect of the present invention, the period is defined by dividing a time which it takes the toner supplied from the toner supplying unit to be transported to the sensor by the number of the shift registers.

According to an aspect of the present invention, the control unit sets the control signal by changing the control signal to 0 if the control signal has a negative value through feedback of the compensating signal.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 4 is a table showing data generated by a toner supplying system of FIG. 3;

DETAILED DESCRIPTION OF THE EMBODIMENTS

Figure 1:
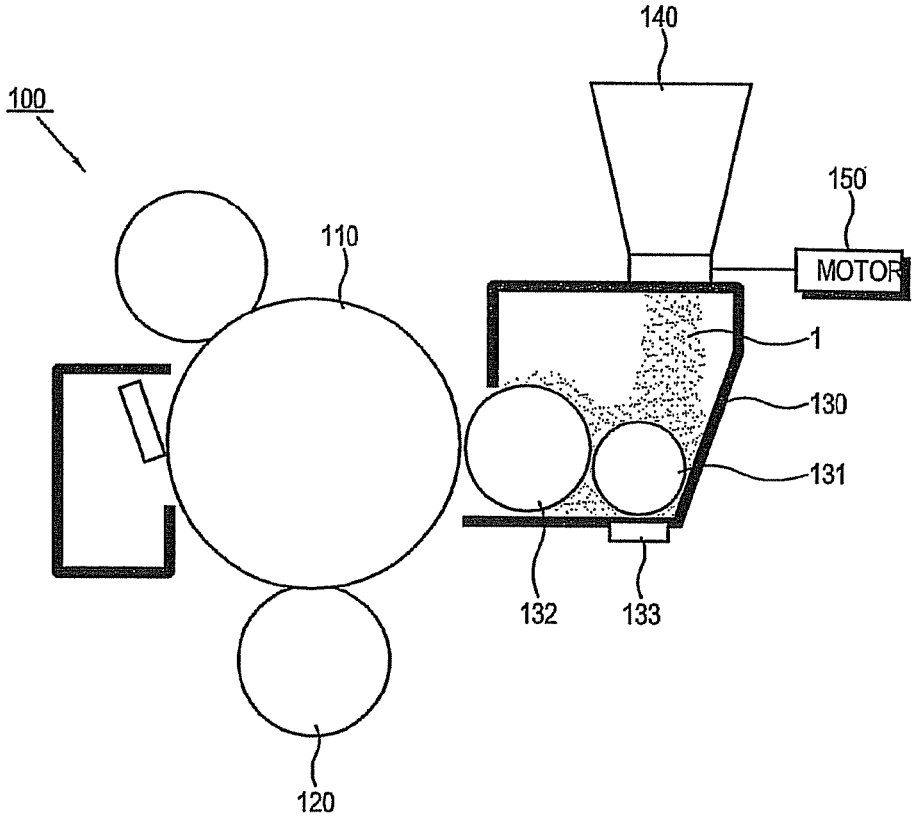
FIG. 1 (CONVENTIONAL ART)
FIG. 1 is a structural diagram showing a conventional image forming apparatus.
Figure 2:
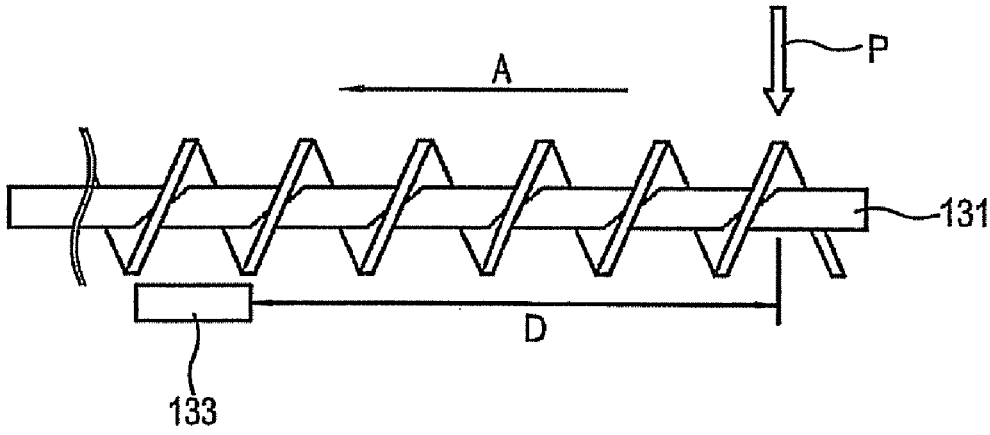
FIG. 2 (CONVENTIONAL ART)
FIG. 2 is a diagram for illustrating process of transporting a toner in the apparatus of FIG. 1.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 3:
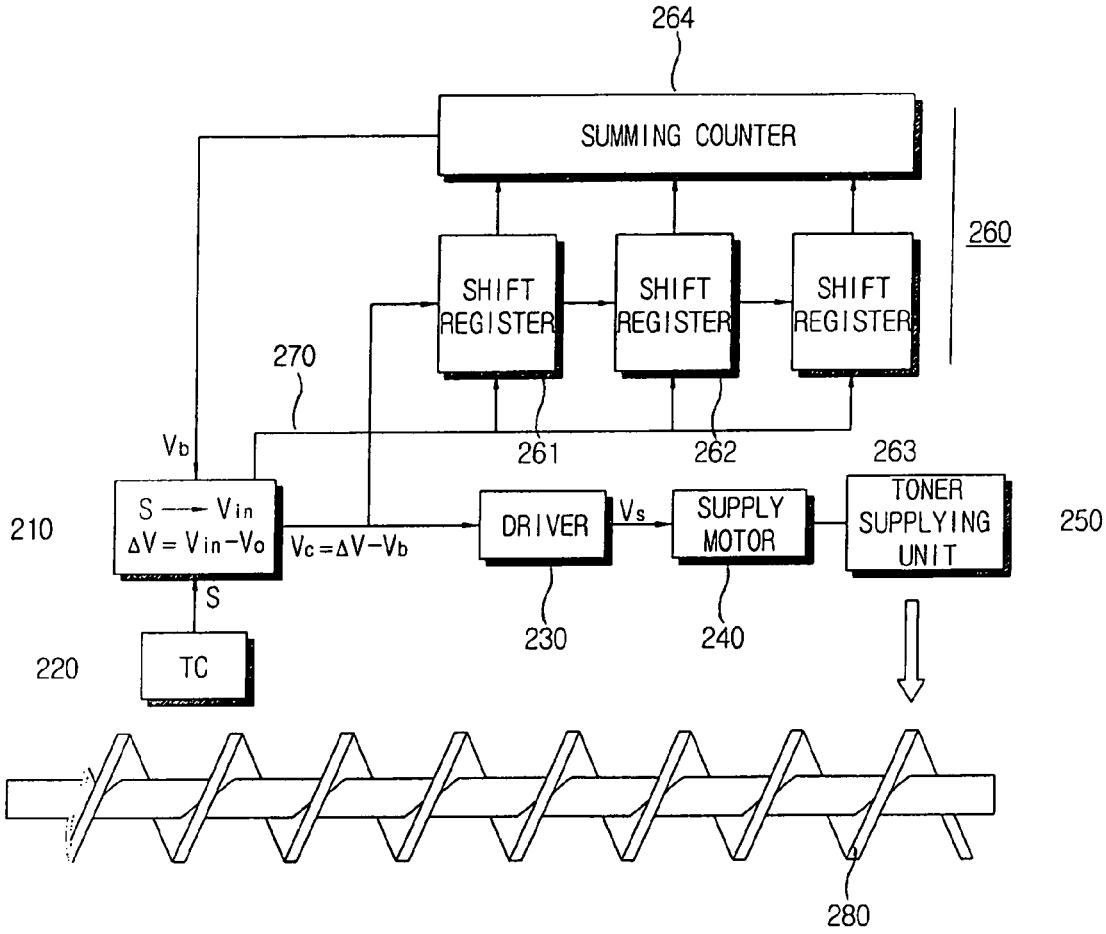
FIG. 3 is schematic structural diagram showing an image forming apparatus according to an embodiment of the present invention.

An image forming apparatus, according to an embodiment of the present invention, comprises a toner supplying system 200, as shown in FIG. 3. As shown in FIG. 3, a control unit 210 controls a driver 230 by generating a control signal, Vc, using a sensing signal S received from a sensor 220, and the driver 230 controls toner supply of a toner supplying unit 250 by driving a supply motor 240. Meanwhile, the toner supplying system 200 includes a compensating signal generating unit 260 to compensate for amounts of toner which are pre-supplied by the toner supplying unit 250 upon a generation of the control signal, Vc, of the control unit 210.

The compensating signal generating unit 260 includes a plurality of shift registers 261, 262, 263 to receive the control signal, Vc, of the control unit 210 at a predetermined period to consecutively store the control signal, Vc, and a summing counter 264 to read out values stored in each of the shift registers 261, 262, 263 to sum them. A time period used for receiving and storing in the shift register 261, 262, 264 and summing in the summing counter 264 is transferred through a clock line 270 that simultaneously occurs between the control unit 210 and the shift registers 261, 262, 263.

The value summed by the summing counter 264 is fed back to the control unit 210 as the compensating signal, Vb, of the compensating signal generating unit.

A process of operating the toner supplying system 200 with such structure will now be described.

First, the toner supplied from the toner supplying unit 250 is transported from the right to the left of the drawing by the toner transporting unit 280 to be sensed by the sensor 220. The density of the toner sensed by the sensor 220 is inputted to the control unit 210 as a sensing signal S.

The control unit 210 converts the density of the toner corresponding to the sensing signal, S, into an input signal, $V_{in}$, and outputs the control signal, Vc, which reflects the difference, ($\Delta V=V_{in}-V_o$), of a pre-stored target signal, $V_o$, from the input signal thereby transmitting the control signal, Vc, to the driver 230. The driver 230 controls the toner supplying unit 250 by driving the supply motor 240 based on the control signal, Vc.

Meanwhile, the control signal, Vc, generated in the control unit 210, is consecutively stored in the plurality of shift registers 261, 262, 263 at a prescribed period, T.

Herein, according to an embodiment of the invention, the number of the shift registers is 3. And the operating period, T, in the shift registers 261, 262, 263 and summing counter 264 is a value obtained by dividing a time t which the toner supplied from the toner supplying unit 250 to the toner transporting unit 280 takes to reach the sensor 220 by the number of shift registers 261, 262, 263, that is, T=t/3.

Consequently, each of the shift registers 261, 262, 263 receives the control signal, Vc, 3 times to consecutively store the control signal, Vc, until the toner supplied from the toner supplying unit 250 reaches the sensor 220. Further, the summing counter 264 receives values stored in the respective shift registers 261, 262, 263 every period, T, and sums them to generate the compensating signal, $V_b$. Further, the control unit 210 receives the compensating signal, $V_b$, from the summing counter 264 as a feedback signal every period, T.

As a result, the control unit 210 generates the control signal, Vc, by receiving the compensating signal, $V_b$, from the summing counter 264 while computing the input signal, $V_{in}$, for the present density of the toner using the sensing signal, S, received from the sensor 220 every period, T.

FIG. 4 is a table to illustrate a process in which various signals are inputted/outputted and stored in the control unit 210 and the compensating signal generating unit 260 in processes of supplying the toner.

In the table of FIG. 4, $V_{in}$, represents the input signal converted by the control unit 210 upon an inputting of the sensing signal, S, of the sensor 220. $S_1$, $S_2$, and $S_3$ represent data stored in corresponding shift registers 261, 262, 263 respectively. Lastly, $V_b$ represents the compensating signal generated by computation of the summing counter 264. Herein, $S_1$ has the same value as the control signal, Vc, generated by the control unit 210 (See FIG. 3).

Figure 5:
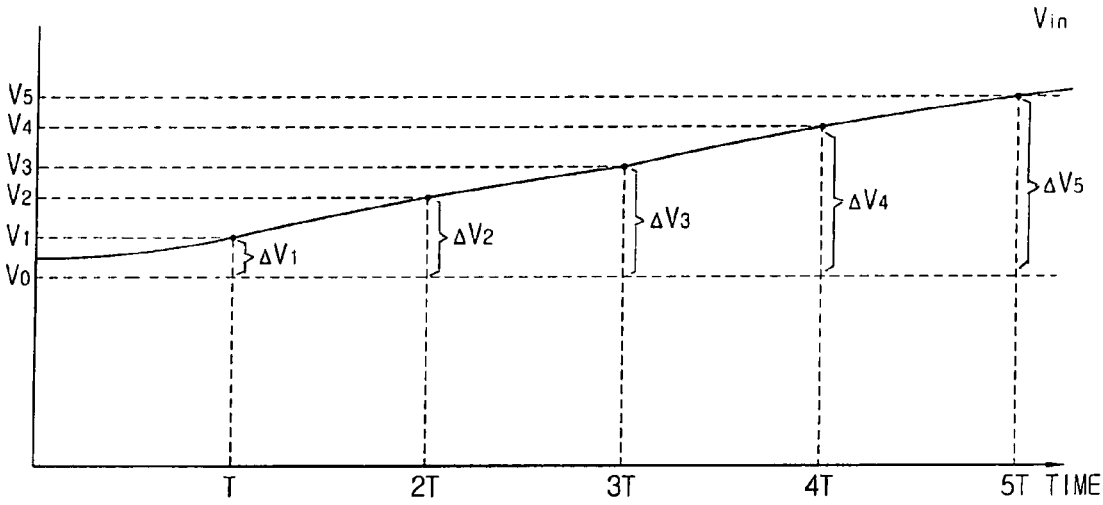
FIG. 5 is a graph for illustrating the table of FIG. 4.

FIG. 5 is a graph representing values after the sensing signal, S, inputted from the sensor 220, is converted into the input signal, $V_{in}$, by the control unit 210.

With reference to FIG. 4 and FIG. 5, the processes of supplying the toner will be described. As shown in FIGS. 4 and 5, in a initial operation, a value of 0 is stored in each of the shift registers 261, 262, 263 and the input signal of $V_1$ is received in the control unit 210 after time corresponding to the period, T=t/3, is elapsed. Consequently, the control unit 210 generates the control signal, Vc, of difference, $\Delta V_1=V_1-V_0$, of a target signal, $V_0$, indicating a proper toner density from the input signal, $V_1$, to transmit it into the driver 230. The driver 230 drives the supply motor 240 based on the control signal, Vc, to operate the toner supplying unit 250 so that the toner is allowed to be supplied.

On the other hand, the control signal, $Vc=\Delta V_1$, is inputted and stored in a first shift register 261 in this process, and the summing counter 264 stores results (i.e., $\Delta V_1$) obtained by summing values (i.e., $\Delta V_1$, 0, 0) stored in the respective shift registers 261, 252, 263 as the compensating signal, $V_b$.

Therefore, since the compensating signal generating unit 260 does not operate until a passage of time corresponding to the first period T after the initial operation, the toner supplying system 200 performs a control of amounts of the toner in a similar manner as in the related art until a first item of data is stored in the summing counter 264.

Further, during a time from T to 2T, the control signal, Vc, corresponding to the value (that is, $\Delta V-\Delta V_1$) obtained by subtracting the compensating signal, $\Delta V_1$, from $\Delta V=V_{in}-V_o$ is transmitted into the driver 230.

Next, upon a passing of a time of 2T after the initial operation, the input signal, $V_{in}$, in the control unit 210 is $V_2$, therefore the difference, $\Delta V_2=V_2-V_o$, of the target signal $V_o$ from the input signal, $V_2$, is computed by the control unit 210. Further, the control unit 210 receives the compensating signal, $\Delta V_1$, stored in the summing counter 264 as the feedback signal to generate a control signal, $Vc=\Delta V_2-\Delta V_1$, by reflecting the compensating signal, $\Delta V_1$, on the computed value, $\Delta V_2$.

Furthermore, at the point in time of 2T, the control signal, $Vc=\Delta V_2-\Delta V_1$, is stored in the first shift register 261 while being transmitted into the driver 230, and the value, $\Delta V_1$, that is pre-stored in the first shift register 261 is transmitted into a second shift register 262. Further, the summing counter 264 updates result obtained by summing the values ($\Delta V_2-\Delta V_1$, $\Delta V_1$, 0) stored in the respective shift registers 261, 262, 263 as the compensating signal ($V_b=(\Delta V_2-\Delta V_1)+\Delta V_1+0=\Delta V_2$) to store the compensating signal.

Therefore, during a time from 2T to 3T, the control signal, Vc, corresponding to a value obtained by subtracting the compensating signal, $\Delta V_2$, from $\Delta V=V_{in}-V_o$ is transmitted into the driver 230.

As such processes are repeatedly performed, the control signal, Vc, of $\Delta V-\Delta V_3$ is generated during a time from 3T to 4T, the control signal, Vc, of $\Delta V-\Delta V_4+\Delta V_1$ is generated during a time from 4T to 5T, and the control signal, Vc, of $\Delta V-\Delta V_5-\Delta V_1+\Delta V_2$ is generated during a time from 5T to 6T.

Herein, the control unit 210 changes the control signal, Vc, to 0 to transmit the changed control signal, Vc, into the driver 230 and the first shift register 261, if the control signal, Vc, generated as a result of a reflection of the compensating signal, Vb, as a feedback signal has a negative value. The driver 230 to which the value of 0 is inputted then stops operating the supply motor 240 so that the toner supplying unit 250 is not allowed to supply the toner.

Figure 6:
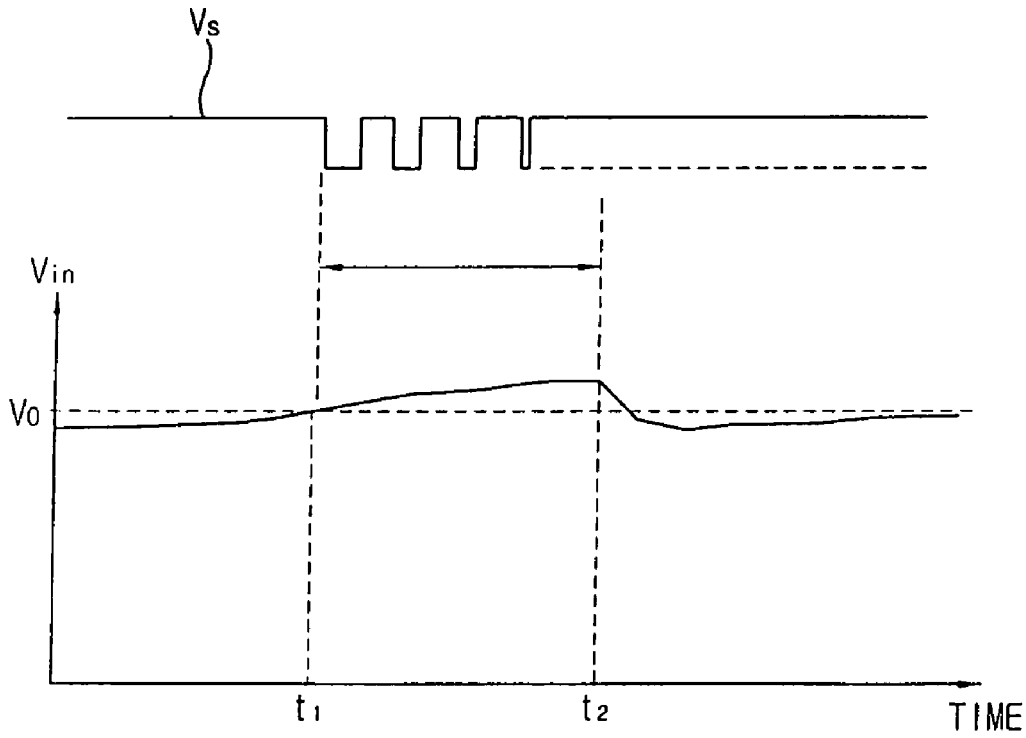
FIG. 6 is a graph for illustrating an input signal measured upon operating the apparatus of FIG. 3.

FIG. 6 is a graph showing a change of the input signal, $V_{in}$, computed through the sensor 220 and the control unit 210 in control of the processes mentioned above. As a time point, $t_1$, passes, the input signal, $V_{in}$, becomes higher than a target signal, $V_o$. Therefore, the toner supplying system (200 in FIG. 3) begins to operate from that point in time. A time point, $t_2$, represents a time when the toner that begins to be supplied from the time point, $t_1$, reaches the sensor 220 through the toner transporting unit 280.

On the other hand, it is appreciated that the toner supply signal, Vs, which is transported from the control signal, Vc, of the control unit 210 to the supply motor 240 through the driver 230, is gradually changed to lower signals as time passes as a result of a performing of the summing process as shown in the table of FIG. 4.

Figure 7:
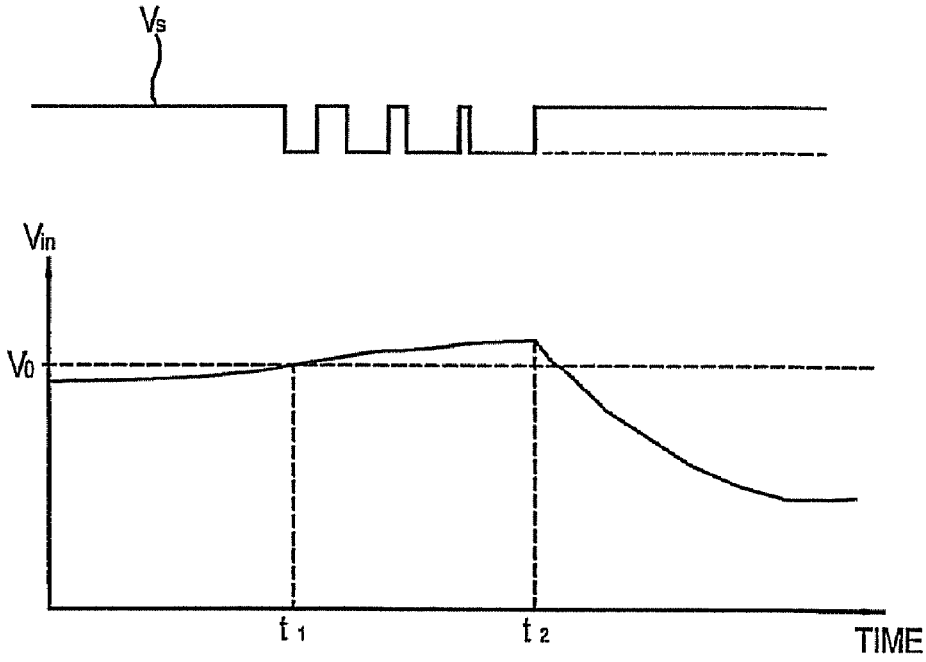
FIG. 7 (CONVENTIONAL ART)
FIG. 7 is a graph for illustrating an input signal measured upon operating the conventional image forming apparatus.

FIG. 7 is a graph illustrating the processes in which the toner supply is controlled through the toner supplying system 200 without the compensating signal generating unit 260 of the related art.

That is, although the toner is supplied from the time point, $t_1$, where the input signal, $V_{in}$, becomes higher than the target signal, $V_o$, feedback control cannot be made until the toner supplied from the toner supplying unit 250 reaches the sensor 220 (that is, time $t_2$), since there is no feedback device such as the compensating signal generating unit 260, according to this invention. However, since the toner that is pre-supplied from the time point, $t_1$,to the time point, $t_2$, is not reflected on the control signal, Vc, it may be found that there is an abrupt change in the input signal, $V_{in}$, since the time point, $t_2$, that is, an overflow in toner supply.

However, as shown in FIG. 6, it may be appreciated that the embodiment of the present invention to which the compensating signal generating unit 260 is applied shows the input signal, $V_{in}$, that is comparatively close to the target signal, $V_o$, without the overflow such as shown in FIG. 7. Meanwhile, though the image forming apparatus, according to aspects of the present invention, may be suitably applied to 2-component toner including toner and a carrier, it is not limited thereto and may be widely applied to devices to control toner supply.

As described above, aspects of the present invention provide an image forming apparatus capable of preventing an excessive supply of toner by controlling toner supply.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An image forming apparatus, comprising:

a toner supplying unit to supply toner;

a toner transporting unit to transport the toner supplied from the toner supplying unit;

a sensor to sense a density of the toner transported by the toner transporting unit;

a compensating signal generating unit to compensate for amounts of the toner pre-supplied by the toner supplying unit; and a control unit to generate a control signal to control the toner supplying unit by receiving a sensing signal of the sensor as an input signal and a compensating signal of the compensating signal generating unit as a feedback signal, wherein the compensating signal generating unit comprises:

a plurality of shift registers to consecutively update the control signal of the control unit at a prescribed period and to store the control signal; and a summing counter to sum the control signal stored in the plurality of shift registers at the prescribed period to generate the compensating signal.

2. The image forming apparatus according to claim 1, wherein the period is defined by dividing a time required for the toner that is supplied by the toner supplying unit to be transported to the sensor by the number of the shift registers.

3. The image forming apparatus according to claim 1, wherein the control unit sets the control signal by changing the control signal to 0 if the control signal has a negative value through feedback of the compensating signal.

4. An image forming apparatus, comprising:

a toner supplying unit to provide a supply of toner to the apparatus;

a toner transporting unit to transport the toner supplied by the toner supplying unit to the apparatus;

a sensor to sense a density of the toner transported by the toner transporting unit and to generate a sensor signal in accordance with the sensed density;

a compensating signal generating unit to generate a compensating signal to indicate how to compensate for amounts of the toner that are pre-supplied by the toner supplying unit; and a control unit to control the toner supplying unit to supply more or less toner by analyzing the sensor signal and the compensating signal, wherein the compensating signal generating unit comprises:

a plurality of shift registers to consecutively update the control signal of the control unit at a prescribed period and to store the control signal; and a summing counter to sum the control signal stored in the plurality of shift registers at the prescribed period to generate the compensating signal.

5. The image forming apparatus according to claim 4, wherein the period is defined by dividing a time required for the toner that is supplied by the toner supplying unit to be transported to the sensor by the number of the shift registers.

6. The image forming apparatus according to claim 4, wherein the control unit controls the toner supplying unit by generating a control signal, and setting the control signal by changing the control signal to 0 if the control signal has a negative value through feedback of the compensating signal.

7. A method of operating a toner supplying system, including a toner supplying unit and a toner transporting unit, for use with an image forming apparatus to which the toner is supplied, the method comprising:

transporting a supply of toner to the apparatus, sensing a present density of the transported toner, and generating a present input signal in accordance with the sensed result; and generating an initial control signal in accordance with a difference between a target signal and the input signal;

storing values of the initial control signal in various shift registers at a predetermined period;

summing the values stored in the various shift registers to generate a compensating signal;

generating a new control signal based on the present input signal and the compensating signal;

controlling the toner supplying unit to increase or decrease a supply of toner based on the new control signal.

8. The method according to claim 7, wherein the initial control signal is stored in three shift registers.

9. The method according to claim 8, wherein the predetermined period is obtained by dividing a time required for the toner to be supplied from the toner supplying unit to the toner transporting unit by the number of shift registers.

10. The method according to claim 7, wherein the generating of the compensating signal is preceded by a delay during which a predetermined control of amounts of supplied toner is accomplished.

* * * * *